US010512328B2

(12) United States Patent
Pan et al.

(10) Patent No.: US 10,512,328 B2
(45) Date of Patent: Dec. 24, 2019

(54) RETRACTION DEVICE AND PULL-OUT GUIDE

(71) Applicant: Paul Hettich GmbH & Co. KG, Kirchlengern (DE)

(72) Inventors: Forest Pan, Zhuhai (CN); Bode Zeng, Zhuhai (CN); Femmy Wang, Zhuhai (CN); Roy Chen, Zhuhai (CN); Kai-Uwe Ruede, Ahrensburg (DE)

(73) Assignee: Paul Hettich GmbH & Co. KG, Kirchlengern (DE)

( * ) Notice: Subject to any disclaimer, the term of this patent is extended or adjusted under 35 U.S.C. 154(b) by 0 days.

(21) Appl. No.: 16/084,653

(22) PCT Filed: Mar. 10, 2017

(86) PCT No.: PCT/EP2017/055706

§ 371 (c)(1),
(2) Date: Sep. 13, 2018

(87) PCT Pub. No.: WO2017/157796

PCT Pub. Date: Sep. 21, 2017

(65) Prior Publication Data

US 2019/0069672 A1 Mar. 7, 2019

(30) Foreign Application Priority Data

Mar. 16, 2016 (CN) ..... 2016 1 0150855
Mar. 18, 2016 (DE) ..... 10 2016 105 100

(51) Int. Cl.
*A47B 88/467* (2017.01)
*A47B 88/487* (2017.01)
(Continued)

(52) U.S. Cl.
CPC ..... *A47B 88/467* (2017.01); *A47B 88/477* (2017.01); *A47B 88/487* (2017.01); *E05F 3/108* (2013.01); *E05Y 2900/20* (2013.01)

(58) Field of Classification Search
CPC ..... A47B 88/453; A47B 88/46; A47B 88/463; A47B 88/467; A47B 88/47; E05F 1/16; E05F 3/108
See application file for complete search history.

(56) References Cited

U.S. PATENT DOCUMENTS 6,971,729 B1 12/2005 Kim et al.
7,600,828 B2 * 10/2009 Chen ..... A47B 88/467 312/319.1
(Continued)

FOREIGN PATENT DOCUMENTS

DE 102006019351 A1 10/2007
DE 202009009566 U1 11/2009
(Continued)

OTHER PUBLICATIONS

International Search Report of PCT/EP2017/055706, dated May 12, 2017 German Search Report of DE10 2016 105 100.4, dated Jan. 17, 2017.

*Primary Examiner* — Daniel J Rohrhoff
(74) *Attorney, Agent, or Firm* — Collard & Roe, P.C.

(57) ABSTRACT

A retraction device, in particular for pull-out guides, has a housing, in which a guide for a linearly movable slider and a guide track for a driver attached to the slider are provided. The driver can be coupled with an activator and a damper comprising a damper housing and a piston rod is provided between the housing and the slider. There is a pull-out guide with a stationary guide rail and a running rail which is movable relative to the guide rail.

10 Claims, 17 Drawing Sheets

(51) Int. Cl.
*A47B 88/477* (2017.01)
*E05F 3/10* (2006.01)

(56) References Cited

U.S. PATENT DOCUMENTS

| | | | | |
|---|---|---|---|---|
| 8,827,388 | B2 * | 9/2014 | Johansson | E05F 1/16<br>312/333 |
| 2002/0011766 | A1 * | 1/2002 | Kim | A47B 88/467<br>312/319.1 |
| 2009/0140621 | A1 * | 6/2009 | Yang | A47B 88/467<br>312/319.1 |
| 2009/0230830 | A1 * | 9/2009 | Ng | A47B 88/467<br>312/333 |
| 2013/0104339 | A1 * | 5/2013 | Shimizu | E05F 1/16<br>16/72 |
| 2014/0072248 | A1 * | 3/2014 | Chen | A47B 88/47<br>384/20 |
| 2014/0079347 | A1 * | 3/2014 | Huang | A47B 88/467<br>384/21 |

FOREIGN PATENT DOCUMENTS

| | | | |
|---|---|---|---|
| DE | 102010037826 | A1 | 3/2012 |
| DE | 202011109548 | U1 | 5/2013 |
| WO | 2006/025149 | A1 | 3/2006 |
| WO | 2008/139298 | A1 | 11/2008 |

* cited by examiner

RETRACTION DEVICE AND PULL-OUT GUIDE

CROSS REFERENCE TO RELATED APPLICATIONS

This application is the National Stage of PCT/EP2017/055706 filed on Mar. 10, 2017, which claims priority under 35 U.S.C. § 119 of Chinese Application No. 201610150855.1 filed on Mar. 16, 2016 and German Application No. 10 2016 105 100.4 filed on Mar. 18, 2016, the disclosures of which are incorporated by reference. The international application under PCT article 21(2) was not published in English.

BACKGROUND OF THE INVENTION

The present invention relates to a retraction device, in particular for pull-out guides, comprising a housing, in which a guide for a linearly movable slider and a guide track for a driver attached to the slider are provided, wherein the driver can be coupled with an activator and a damper comprising a damper housing and a piston rod is provided between the housing and the slider, and a pull-out guide with a stationary guide rail and a running rail which is movable relative to the guide rail.

U.S. Pat. No. 6,971,729 B1 discloses a retraction device having a driver that can slide along a housing. The driver can be coupled with an actuator of a pull-out guide rail. The driver is thereby pretensioned in a retracted position by means of a spring, which is guided along a pin on the housing. This retraction device has the disadvantage that no damping forces can be applied in order to slow down the closing movement of a rail.

Further, DE 20 2011 109 548 U1 discloses a device for closing a movable part of a piece of furniture having a driver that can slide along a housing. The driver is coupled with a linear damper comprising a damper housing, in which a spring is additionally arranged, in order to pretension the driver in a retracting direction. However, the spring arranged in the damper housing can only provide low tension and cannot be replaced in case of damage without having to remove the damper completely.

SUMMARY OF THE INVENTION

It is therefore the object of the present invention to provide a retraction device as well as a pull-out guide comprising such a retraction device, which is constructed in a simple and compact way and provides sufficient tension for pre-tensioning the driver.

The object of the present invention is achieved using a retraction device comprising the features of claim 1. Further, a pull-out guide comprising such a retraction device as described in claim 8 is provided according to the present invention.

The retraction device according to the present invention comprises a slider which is movably mounted on a housing and which is pretensioned in the retracting direction by means of a spring, wherein a damper with a damper housing and a piston rod is additionally provided in order to slow down a relative movement between the slider and the housing, wherein the spring is arranged around the damper. This results in a particularly compact construction, as the damper is surrounded by the spring and the space inside the spring is used. Moreover, the spring can be easily replaced in case of damage and exert sufficient spring tension in order to pretension the slider in the retracting direction.

Preferably, the spring is designed as a spiral spring being arranged around the damper housing. The damper housing may optionally serve as a guide for the spiral spring or be arranged inside the spiral spring without contact.

According to one embodiment of the invention, the spring is designed as a tension spring, which is detensioned in its retracted position. Consequently, the spring only takes up minimum installation space in a detensioned retracted position. Moreover, if a tension spring is used, guide means are mostly not necessary, as, in contrast to a compression spring, it does not slip sideways.

The spring can be fixed on a first end on a first mounting on the housing and on a second end on a second mounting on the slider. Thereby, at least a coil protruding at least partly in the radial direction can be provided on the spring on the first end and/or on the second end each, so that the spring can be easily mounted. The radially protruding coils arranged on the end can be inserted into a pocket or recess, so that the spring can be effortlessly mounted.

The damper together with a damper housing can be held in a recess of the housing, while the slider can be moved together with the piston rod. It is of course also possible to move the slider together with the damper housing and to fix the piston rod on the housing. The damper can thereby be designed as a linear damper, in particular a fluid damper, in order to be able to provide high damping forces.

In order to be able to easily couple the retraction device with a movable component like a pull-out guide or a sliding door, the driver preferably is pivotably mounted on the slider. The driver can thereby slide along the guide track on the housing, in order to lock the spring in a tensioned position, for example when a drawer or a sliding door are moved into an opening position.

If the retraction device is mounted on a stationary component, for example a furniture body, it can be activated by coupling it with an activator, which is mounted on a movable component, for example a sliding door. Vice versa, the retraction device can of course be mounted on the movable component and the activator on the stationary component.

The pull-out guide according to the present invention comprises a stationary guide rail and a running rail that can be moved relative to the guide rail, wherein the retraction device is provided between the running rail and the guide rail. The retraction device can be arranged between the running rail and the guide rail, when the pull-out guide is in its retracted position, so that the retraction device is protected from environmental influences and contamination. The guide rail and the running rail can thereby be C-shaped in cross-section, while the C-shaped legs of the running rail and the guide rail are facing each other. This way, a hollow space is formed between the rails, in which the retraction device is arranged.

In order to activate the retraction device, an activator can be arranged on the running rail or on the element coupled with the running rail, which can be coupled with the driver of the retraction device.

Preferably, a middle rail is arranged between the guide rail and the running rail, the middle rail being shorter than the running rail or the guide rail, wherein the retraction device is arranged as an elongation of the middle rail. Consequently, the available space inside the pull-out guide can be used optimally.

BRIEF DESCRIPTION OF THE DRAWING FIGURES

DETAILED DESCRIPTION OF THE INVENTION

Figures 1, 2:
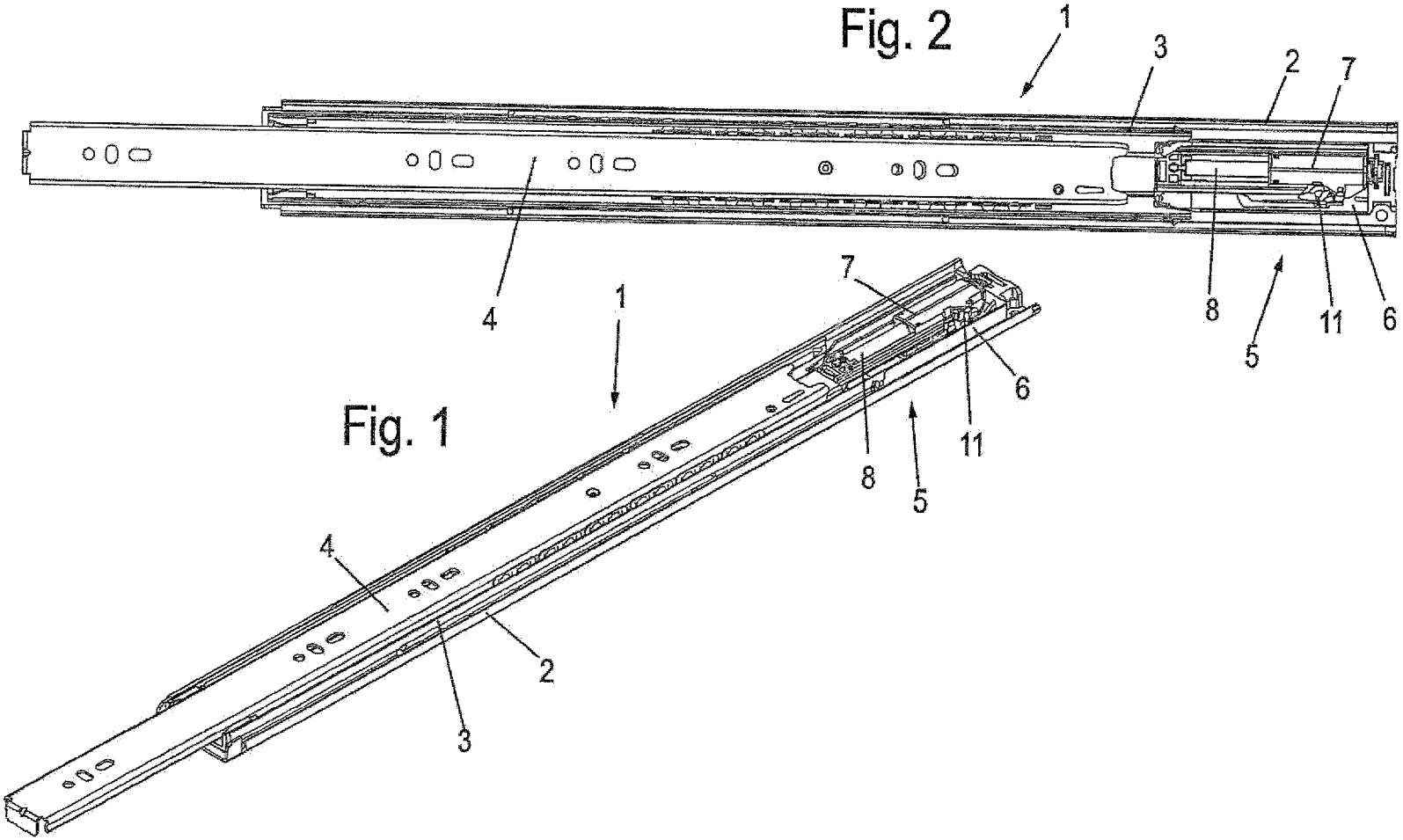
FIG. 1 is a perspective view of a pull-out guide according to the present invention.
FIG. 2 is a top view of the pull-out guide as shown in FIG. 1.

A pull-out guide 1 comprising a stationary guide rail 2, which can be fixed on a furniture body, a middle rail 3 and a running rail 4. The middle rail 3 is arranged between the guide rail 2 and the running rail 4 and is shorter than the other two. In extension of the middle rail 3, a retraction device 5 is provided which is fixed on the guide rail 2 together with a housing 6. The retraction device 5 comprises a movable slider 7, which is connected to a driver 11. The slider 7 is pretensioned in a retracted position by means of a spring 9 and further coupled with a damper 8, in order to slow down the running rail 4 upon its closing movement before reaching its closed position, in order to prevent loud impact noises.

Figure 3:
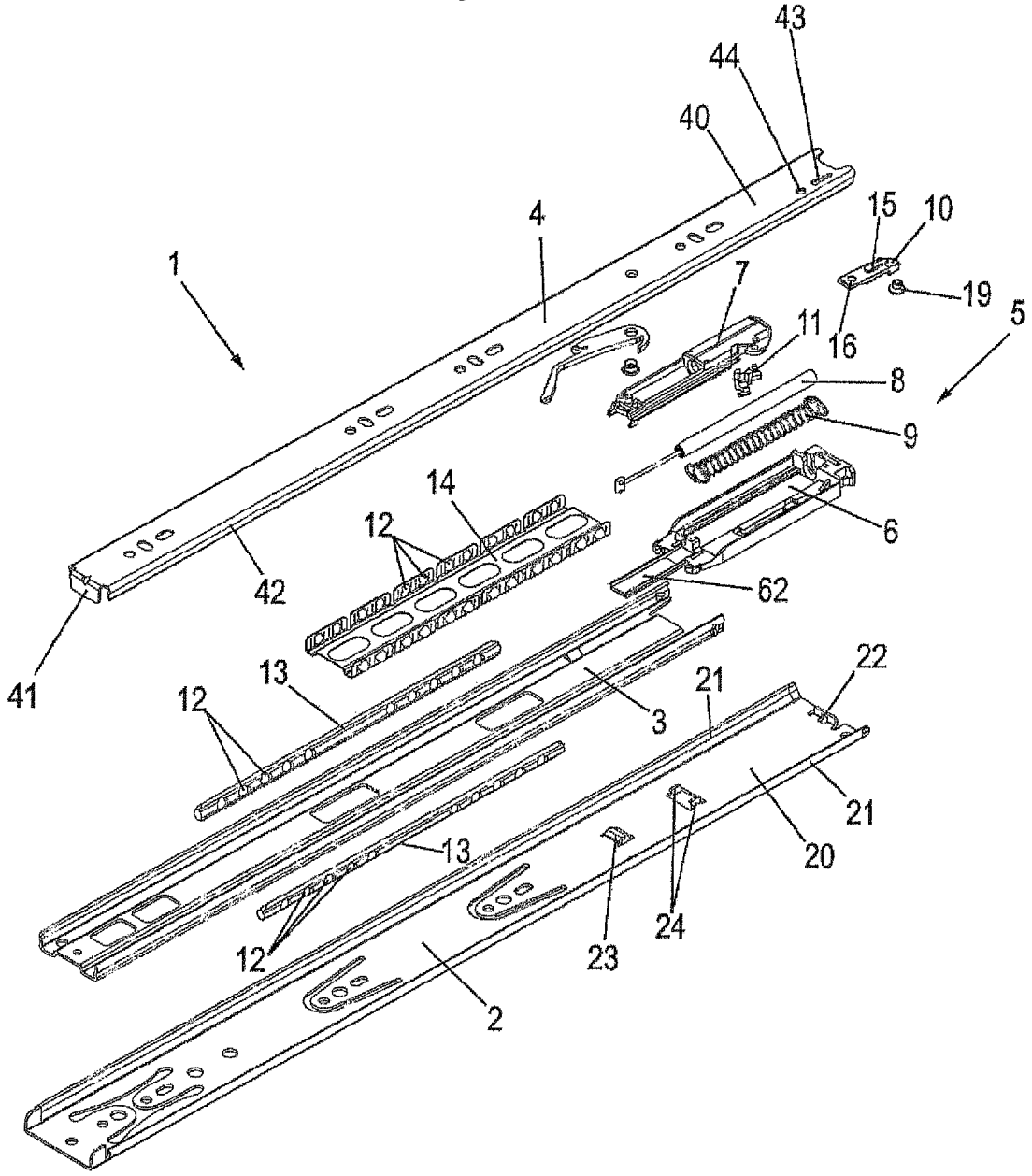
FIG. 3 is a perspective exploded-view drawing of the pull-out guide as shown in FIG. 1.

As shown in FIG. 3, the guide rail 2, the middle rail 3 and the running rail 4 are C- or U-shaped in cross-section. The guide rail 2 has a bottom 20, from which two legs 21 protrude, having running tracks for bearing elements 12. The ball shaped bearing elements 12 are formed on a bearing element cage 13, in order to movably bear the also U-shaped middle rail 3 within the guide rail 2. On the bottom 20 of the guide rail 2, a web 22 is further provided on its front-end side as well as a protruding arm 23 and a holder 24, by means of which the housing 6 of the retraction device 5 can be fixed. The holder 24 serves the purpose of laterally fixating the housing 6, while a web 62 on the housing 6 reaches under the protruding arm 23 and the arm 23 prevents the housing 6 from moving. Other mechanisms for fixing the housing 6 can also be provided.

On the middle rail 3, running tracks for bearing elements 12 are also formed, which are provided on the inner side of the angled webs. The bearing elements 12 inside the middle rail 3 are held on a bearing element cage 14, inside of which the running rail 4 is arranged. The running rail 4 comprises on a longitudinal end an angled web 41 as a stop and parallel to the longitudinal direction webs 42, on which running tracks for the bearing elements 12 are formed. The webs 42 of the running rail 4 are facing the webs on the middle rail 3 and the guide rail 2, so that between the webs 42 and the bottom 40 of the running rail 4 as well as a bottom 20 of the guide rail 2 a chamber is formed, in which the shortened middle rail 3 on the one hand and on the other hand the retraction device 5 are arranged.

On the bottom 40 of the running rail 4, an oblong hole 43 and an opening 44 are provided, which serve the purpose of fixing the activator 10. The activator 10 has an elongated protrusion 15, which can be inserted in the oblong hole 43, and a fixing means 19 can further be inserted into an opening 16 on the activator 10 and the opening 44 on the running rail 4. The activator 10 can be engaged with the driver 11, which is pivotably mounted on the slider 7.

Figure 4:
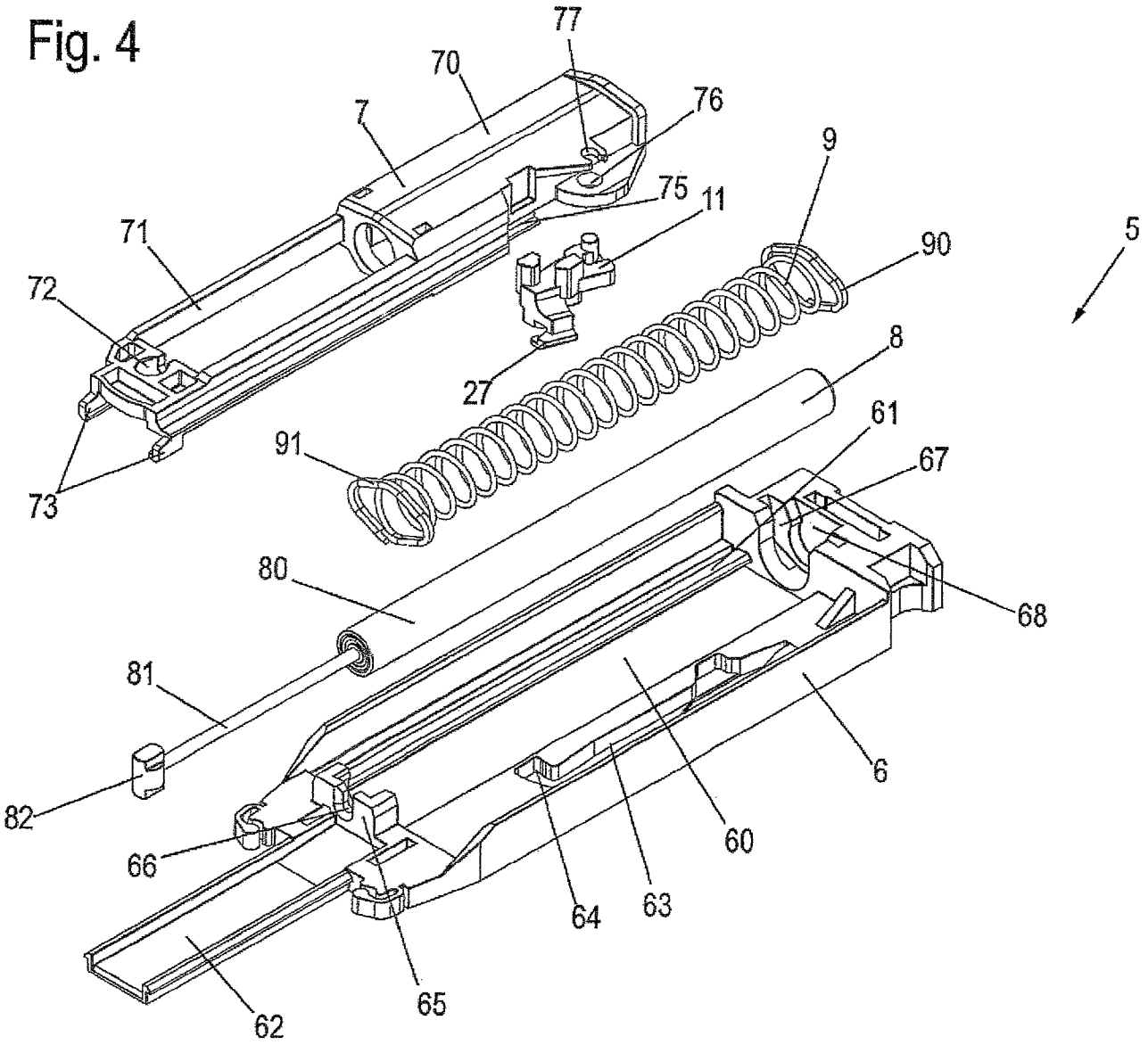
FIG. 4 is a perspective exploded-view drawing of the retraction device of the pull-out guide as shown in FIG. 1.
Figure 5A:
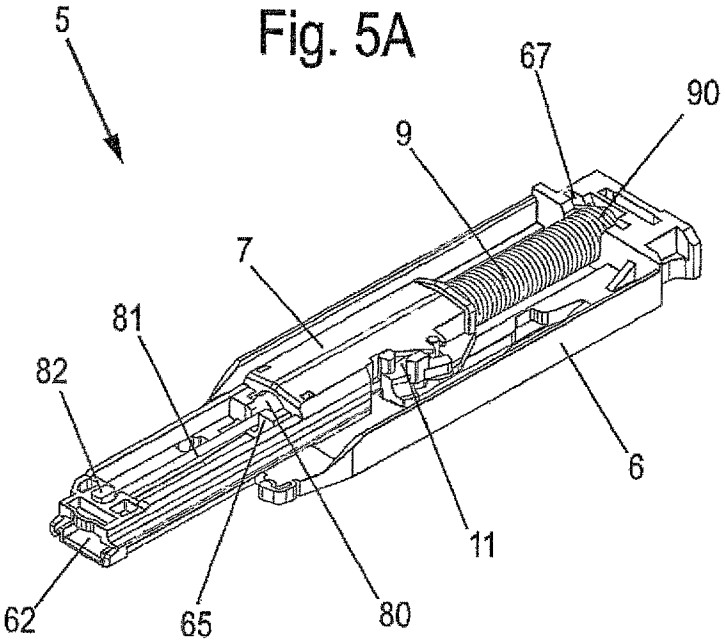
FIGS. 5A to 5D show several views of the retraction device in an extended position.
Figure 5B:
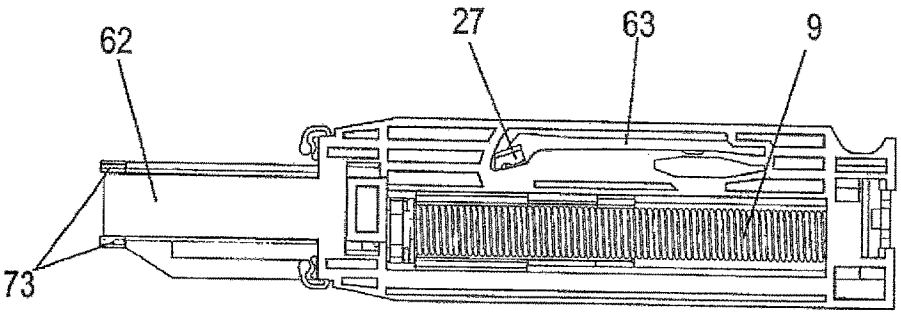
Figure 5C:
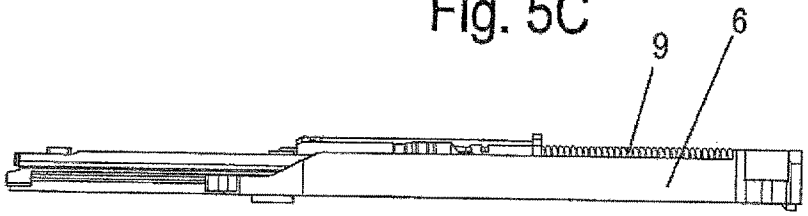
Figure 5D:
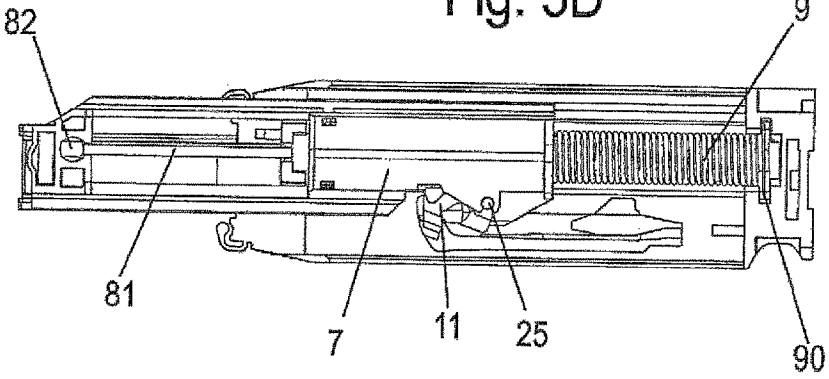
Figure 6A:
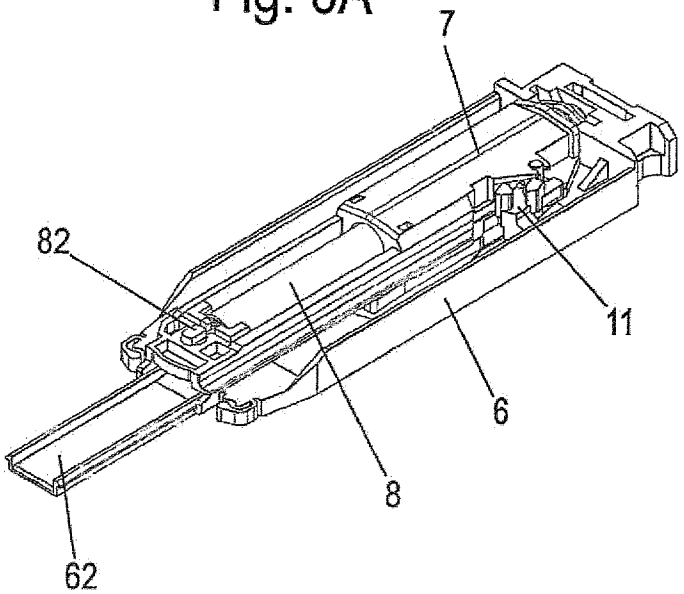
FIGS. 6A to 6D show several views of the retraction device as shown in FIG. 5 in its retracted position.
Figure 6B:
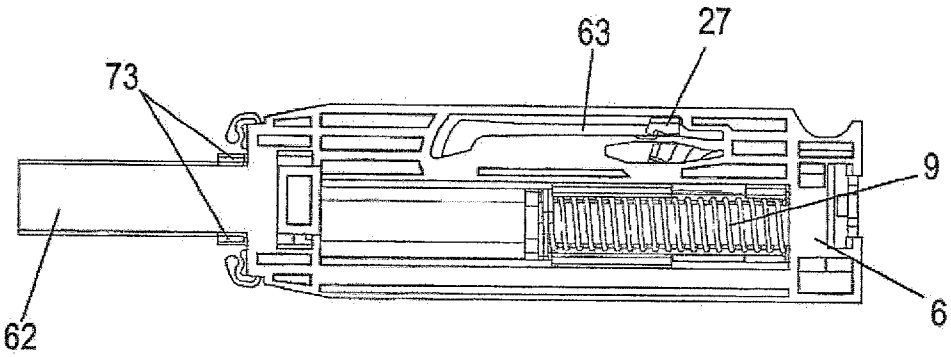
Figure 6C:
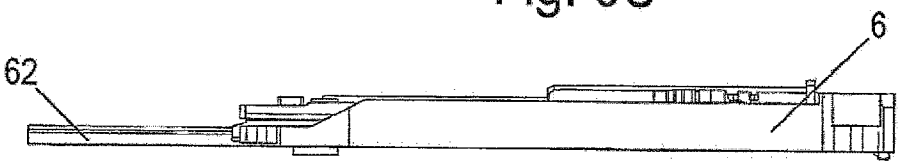
Figure 6D:
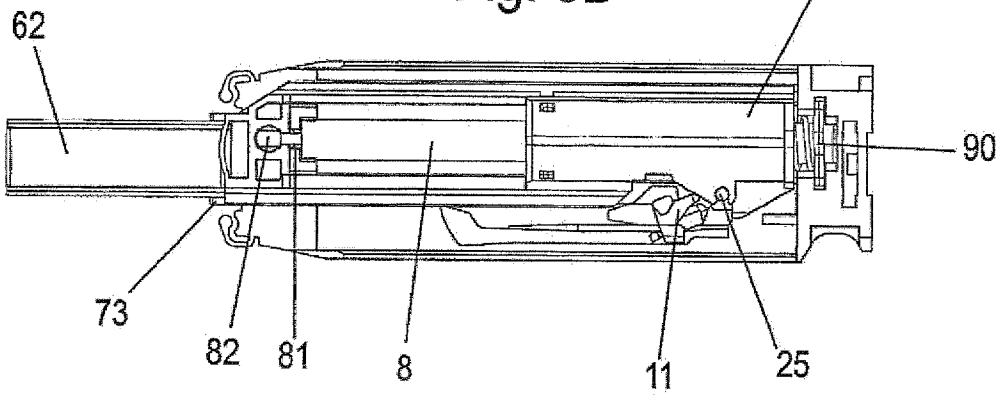

The retraction device 5 is shown in detail in FIG. 4.

The housing 6 comprises a recess 60, into which the damper 8 and the spring 9 can be inserted. Along the recess 60 a strip-shaped guide 61 is formed, which serves the purpose of linearly guiding the slider 7. In extension of the recess 60, a protruding web 62 on the housing 6 is formed, which also serves the purpose of guiding the slider 7 and is surrounded by two sliding elements 73. Between the recess 60 and the web 62 there is a wall portion 65, on which an opening 66 is provided. On the wall portion 65, a front-end side of the damper housing 80 is supported, while a piston rod 81 of the damper 8 is lead through the opening 66. The cylindrical damper housing 80 is supported on the side opposite the piston rod 81 on a wall 68 of the housing 6 and also, if applicable, clipped thereon.

The slider 7 has a recess 70 for a spring 9, wherein the recess 70 is connected via webs 71 extending in the longitudinal direction to a holder 72. On the holder 72 sliding elements 73 are provided in order to guide the slider along the web 62. The holder 72 further comprises an opening, into which a head portion 82 on the piston rod 81 is inserted, so that the slider 7 is connected to the piston rod 81, while the damper housing 80 is attached to the housing 6 or supported thereon.

Furthermore, on the slider 7, a bearing 76 for the driver 11 is formed, so that the driver 11 is held pivotably or rotatably on the slider 7. Above the bearing 76, a latching recess 77 is provided, so that the driver 11 can be latched onto the slider 7 in a pivoting movement. The driver 11 is further held movably on the housing 6 by means of a guide portion 27 along a guide track 63. The guide track 63 comprises an angled end portion 64, in order to be able to latch the driver 11 in a tensioned position of the spring 9.

The spring 9 is designed as a spiral spring and is arranged around the damper housing 80. The spring 9 thereby comprises a first end 90, on which a coil is provided, which protrudes radially at least in some parts. This radially protruding coil is inserted into a pocket 67 or a recess on the housing 6, so that traction and compressive forces can be transmitted on the housing 6. In a similar way, on the opposite side on a second end 91 a radially protruding coil is formed, which can be inserted into a pocket or a recess on the slider 7. If the slider 7 is moved relative to the housing 6, both the spring 9 and the damper 8 are operative.

In FIGS. 5A to 5D, the retraction device 5 is shown in a tensioned position, in which the pull-out guide 1 has been moved in the opening direction. Consequently, the slider 7 is moved along the housing 6 against the tension of the spring 9, until the driver 11 reaches the angled end portion 64 and is pivoted there. By the pivoting movement of the driver 11, a coupling between the driver 11 and the activator 10 has been disengaged, so that the running rail 4 is moveable in this position irrespective of the retraction device 5. The driver 11 stays in the latched position until the activator 10 is moved in the closing direction on the running rail 4, thereby unlatching the driver 11.

When the driver 11 is unlatched, the slider 7 moves further in the closing direction due to the force of the spring 9 and motion energy of the running rail 4 and a component connected to the running rail 4. Consequently, the piston rod 81 is retracted into the damper housing 80, thereby generating braking forces, in order to slow down the movement. The damper 8 can thereby be designed as a fluid damper, for example using silicone oil, in order to also be able to generate damping forces in the case of high weights.

The FIGS. 6A to 6D show the retracting position when the running rail 4 is moved with a drawer in the closing direction. The spring 9 is in a basically detensioned state, and the piston rod 81 is for the most part retracted into the damper housing 80. The driver 11 is positioned together with the guide portion 27 along the linear portion of the guide track 63. The driver 11 is thereby coupled with the activator 10, which is not shown in FIG. 6 for reasons of a simplified representation. When the running rail 4 is then moved in the opening direction, the activator 10 pulls the driver 11 along the guide rail 63 against the tension of the spring 9, and additionally pulls the piston rod 81 out of the damper housing 80. The retraction device 5 can then be transferred back into the tensioned position of FIG. 5.

Figure 7A:
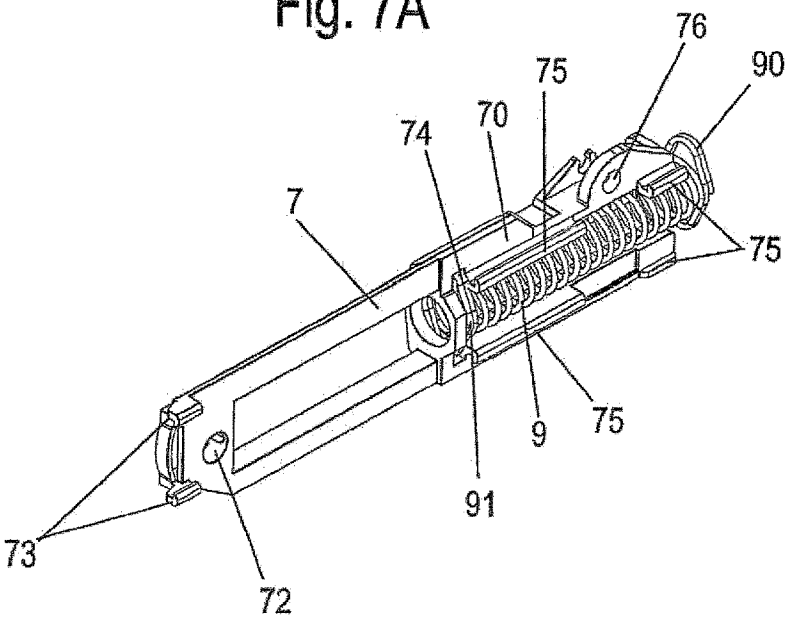
FIGS. 7A to 7C show several views of the slider with the spring of the retraction device as shown in FIG. 4.
Figure 7B:
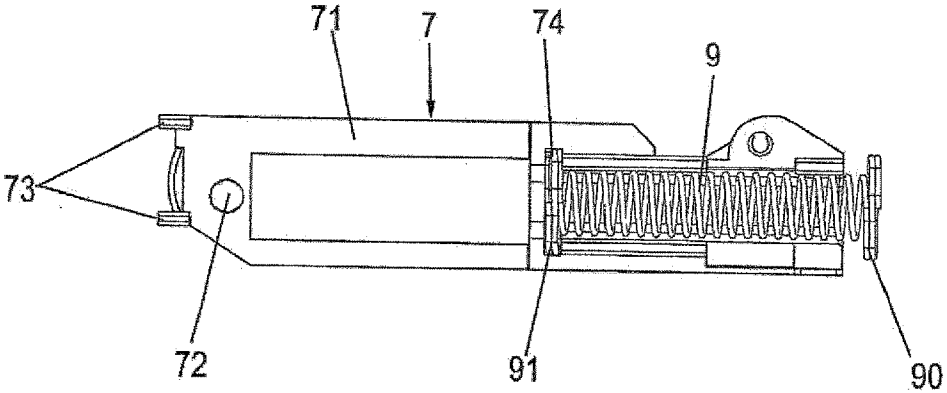
Figure 7C:
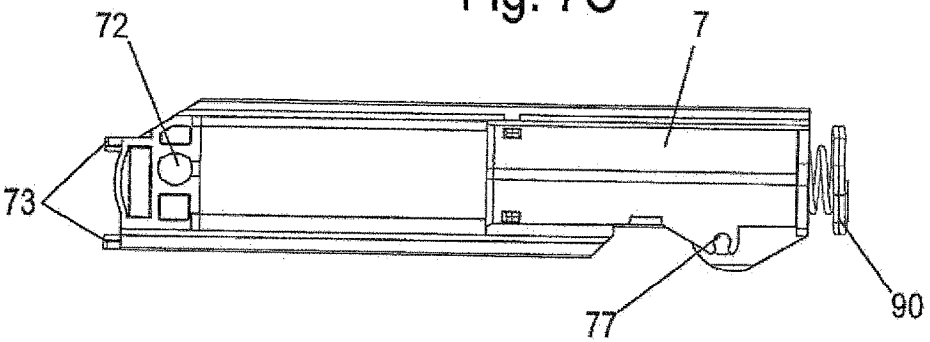

FIGS. 7A to 7C show the slider 7 only including the spring 9. It can be seen that the spring 9 engages with the radially protruding coil on the second end 91 in a pocket 74 or a recess and can transmit traction as well as compressive forces on the slider 7. Further, the bearing 76 for the driver 11 as well as the latching recess 77 can be seen on the slider 7. The slider 7 is guided via guide strips 75 along the guide 61 of the housing.

Figure 8:
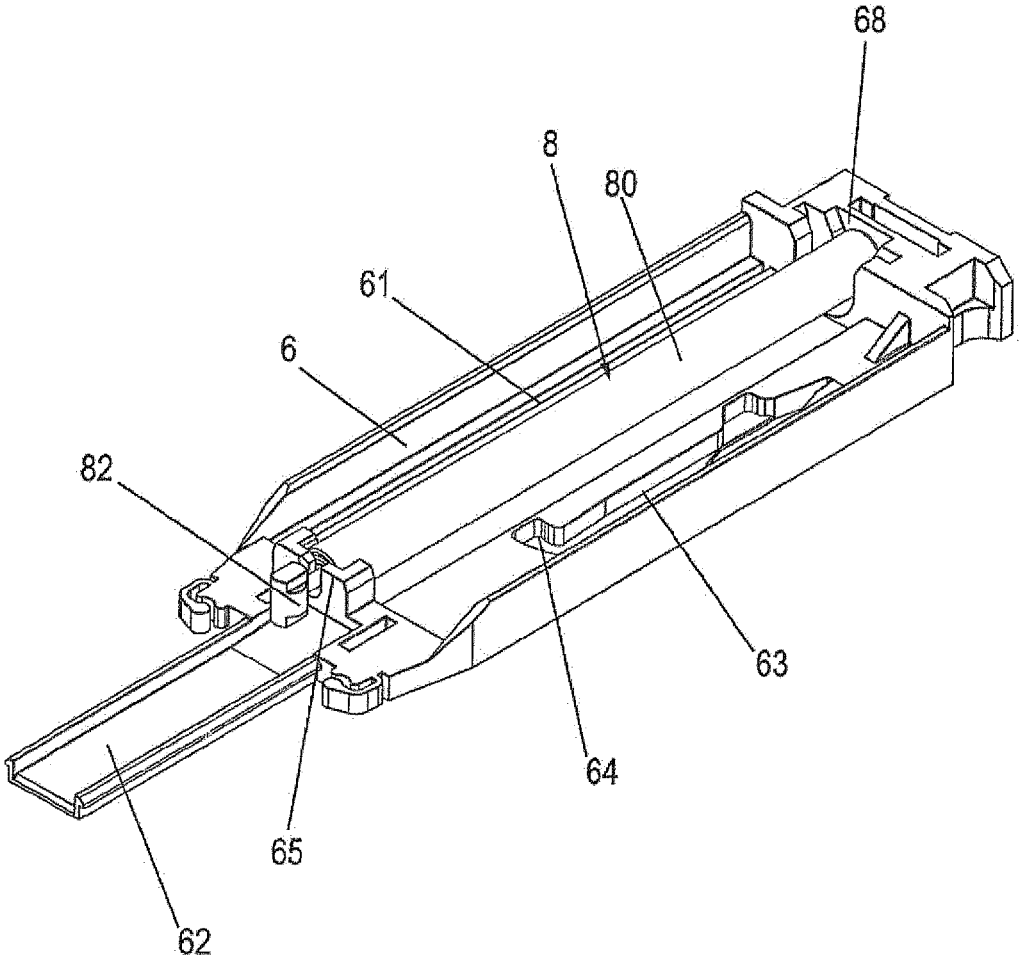
FIG. 8 is a perspective view of the housing of the retraction device with the damper.

FIG. 8 shows the housing 6 only with the damper 8, which is held with the damper housing 80 between the wall 68 and the wall portion 65.

Figure 9:
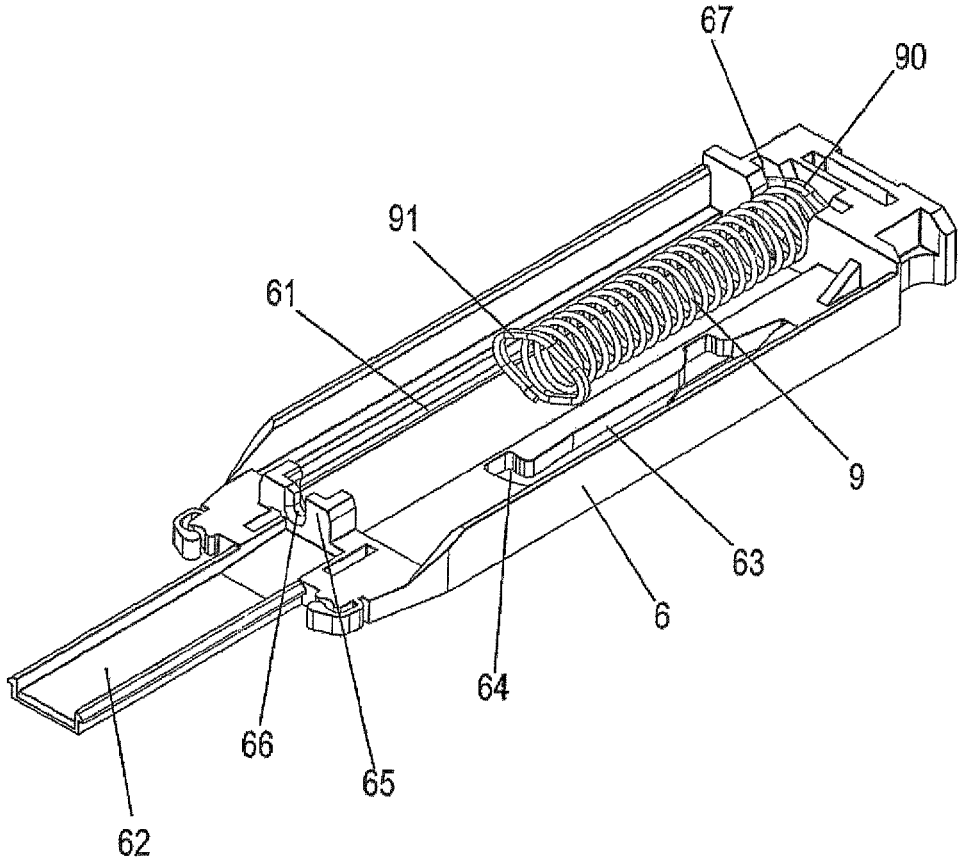
FIG. 9 is a perspective view of the housing with a mounted spring.
Figure 10B:
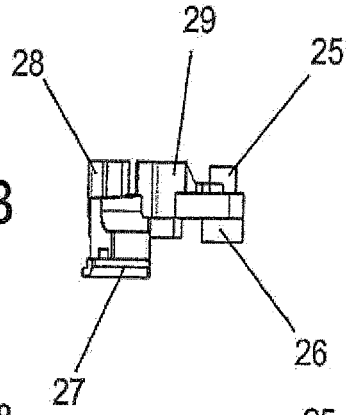
FIGS. 10A to 10D show several views of the driver of the retraction device as shown in FIG. 4.
Figure 10A:
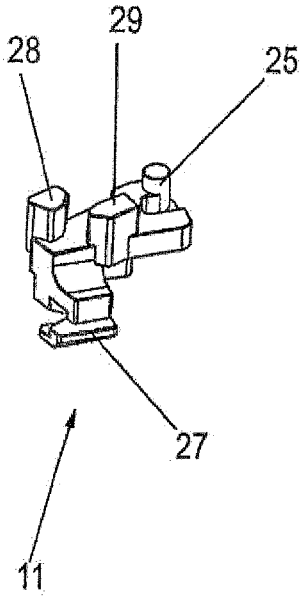
Figure 10C:
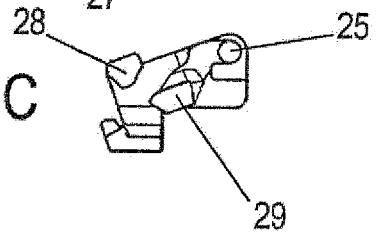
Figure 10D:
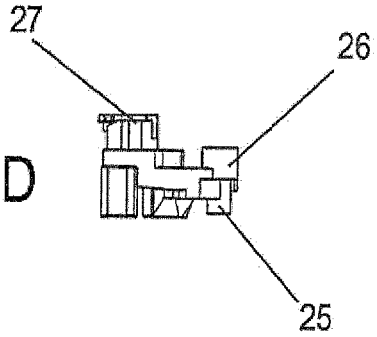
Figure 11B:
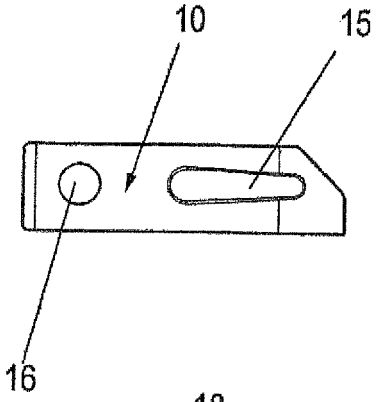
FIGS. 11A to 11D show several views of the activator for the retraction device.
Figure 11A:
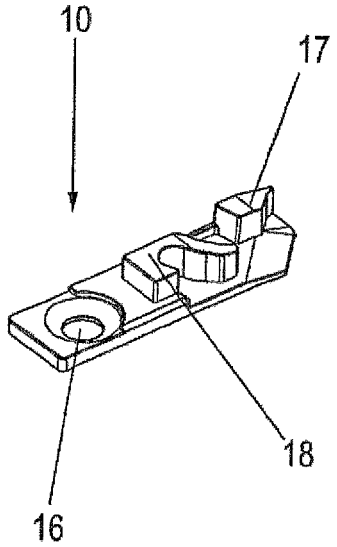
Figure 11C:
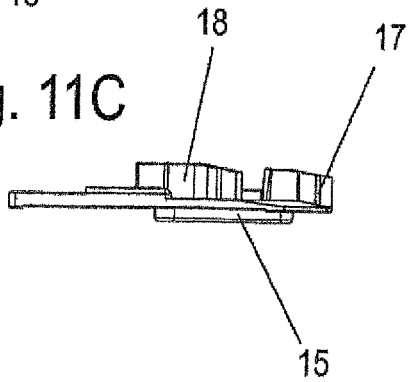
Figure 11D:
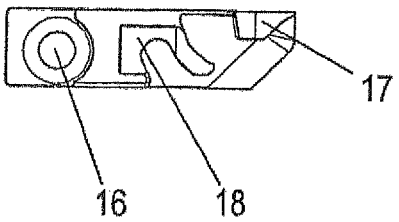

FIG. 9 shows the housing 6 only with the spring 9. The spring 9 is inserted with the first end 90 comprising the radially protruding coil into a pocket 67 of the housing 6. The damper 8 can then be inserted into the spring 9, before the slider 7 is mounted.

In FIGS. 10A to 10D, the driver 11 is shown in detail. The driver 11 comprises a bearing pin 26, which is inserted into the bearing 76 on the slider 7. In the axial extension of the bearing pin 26, a bolt 25 is arranged, which can be inserted into the latching recess 77 on the slider 7, so that the driver 11 can be mounted on the slider 7 without any tools, so that it is mounted rotatably on the slider 7. Further, there is a guide portion 27 on the driver 11, which engages in the guide track 63 of the housing 6. The guide portion 27 thereby reaches through the guide track 63, which is formed as an oblong hole, and is secured against being pulled out. Further, on the driver 11, there are protrusions 28 and 29, which can engage with the activator 10.

The activator 10 is shown in detail in FIGS. 11A to 11D. The activator 10 comprises a protrusion 15 and an opening 16 for fixation on the running rail 4. Further, protrusions 17 and 18 are formed on the activator 10, which can engage with the protrusions 28 and 29 of the driver 11, in order to unlatch the driver 11 from its latched position on the angled end portion 64 and establish a coupling between the activator 10 and the driver 11.

In the shown embodiment, the spring 9 is designed as a tension spring. Further, the damper 8 is designed as a compression damper generating damper forces when the piston rod 81 is inserted into the damper housing 80. It is also possible to design the spring 9 as a compression spring and additionally or alternatively design the damper 8 as a drag damper generating damping forces when the piston rod 81 is pulled out of the damper housing 80.

The retraction device 5 is preferably used in combination with a pull-out guide 1, as shown in FIGS. 1 to 3. It is however also possible to use the retraction device 5 for sliding doors or other movable parts or components of a piece of furniture.

In the described embodiment, the retraction device 5 is used to slow down a running rail 4 during its closing movement in relation to the guide rail 2 and to pull it into its closed end position.

However, it is also possible to use the retraction device 5 in order to draw in and/or slow down the running rail 4 in its opening position. As a result, its opening movement is damped and its opening end position is reached in a reliable way.

Figure 12:
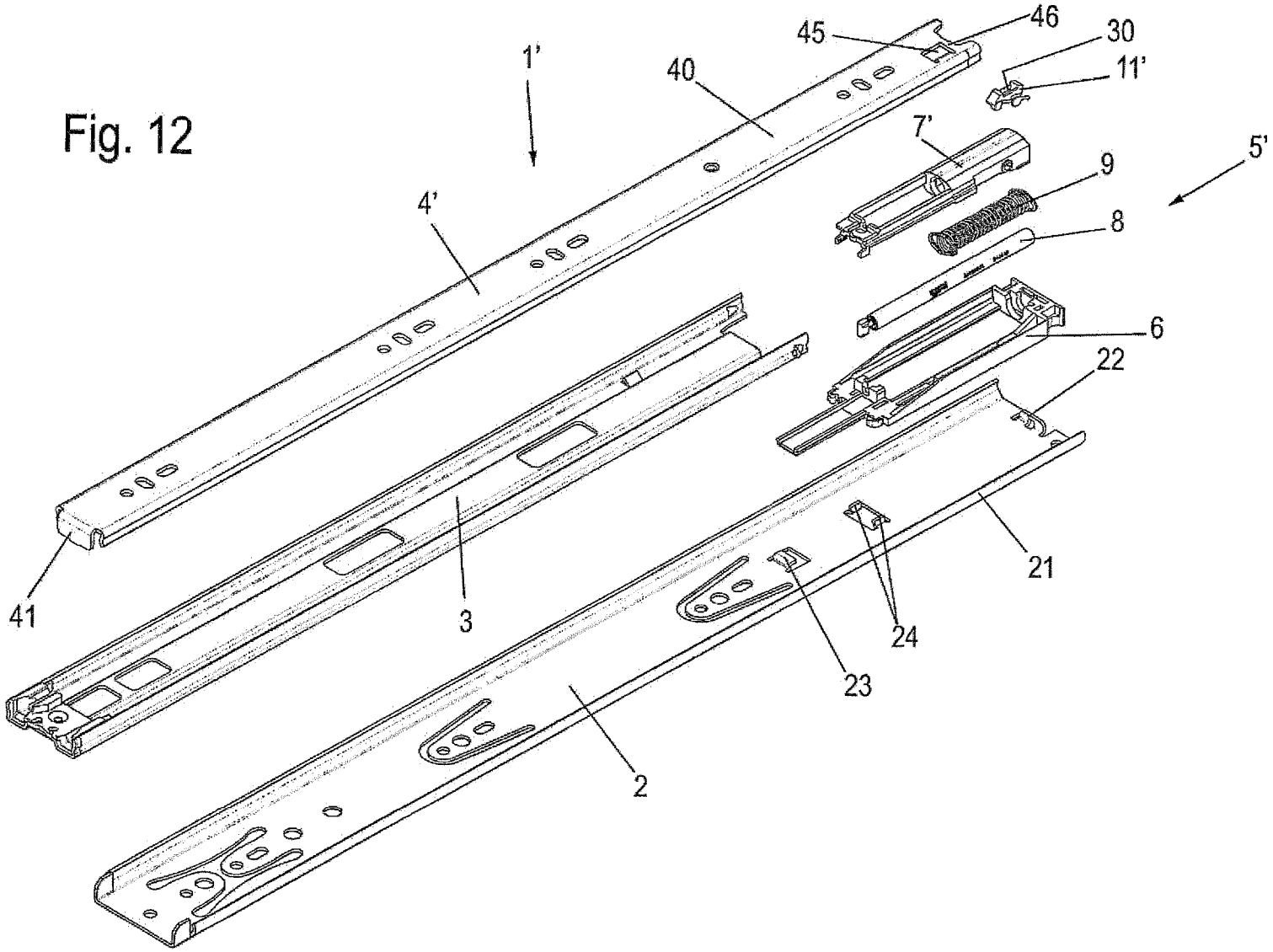
FIG. 12 is a perspective exploded-view drawing of a modified embodiment of a retraction device according to the present invention.

FIG. 12 shows a modified embodiment of a pull-out guide 1', in which the guide rail 2 and the middle rail 3 are designed similar to the previous embodiment. Only the running rail 4' has changed, since no activator is attached to the running rail 4' as a separated component. Instead, a recess 45 is provided on the running rail 4', in order to form a web-shaped activator 46 at the end, which is integrally formed with the running rail 4'. The web-shaped activator 46 can engage with a driver 11' of a modified retraction device 5'.

Figure 13A:
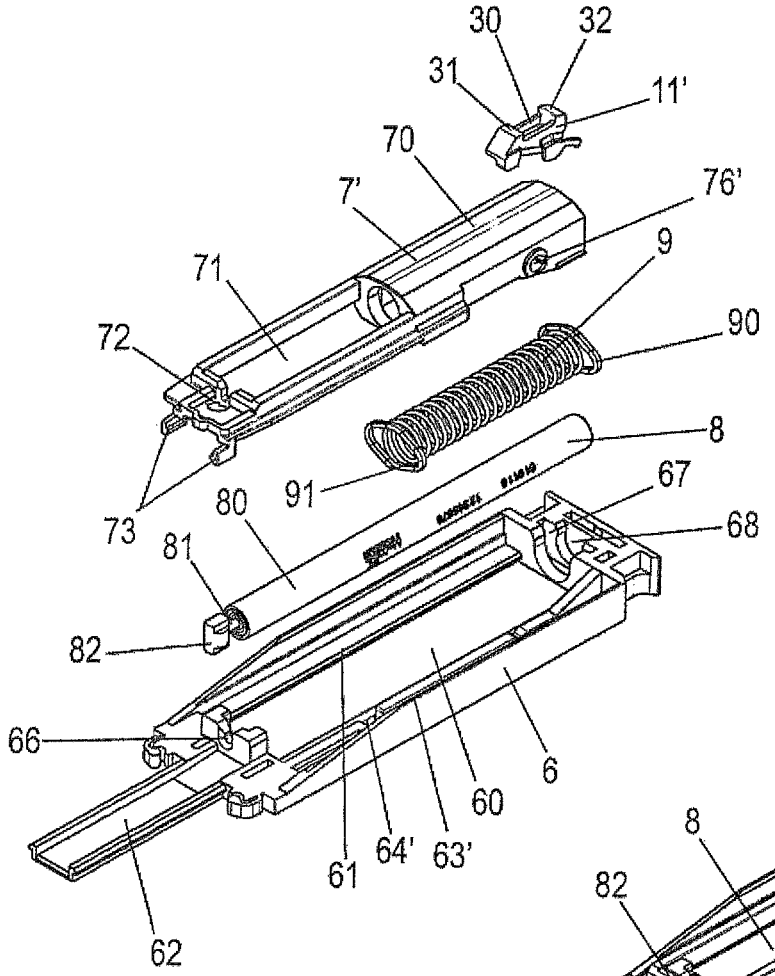
FIGS. 13A and 13B show two views of a retraction device for the pull-out guide as shown in FIG. 12.
Figure 13B:
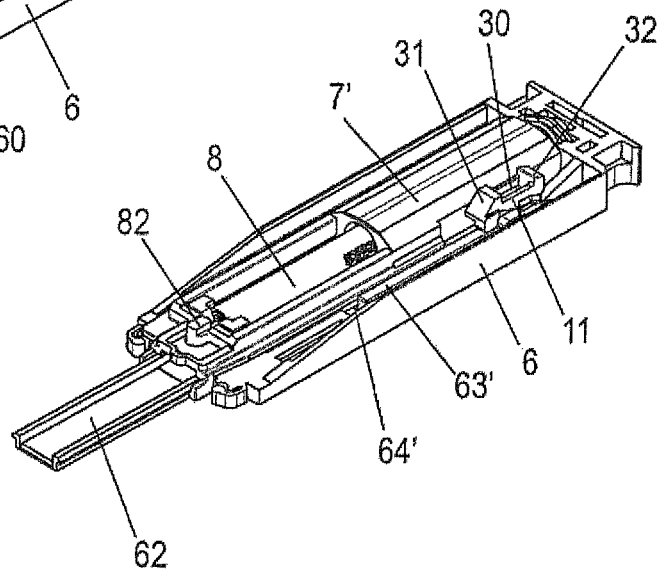

The retraction device 5' is shown in detail in FIGS. 13A and 13B. The driver 11' is held rotatably on the slider 7', wherein for this purpose an opening 76' is formed on the slider 7', in which a pin of the driver 11' engages. Contrary to the first embodiment, in which the driver 11 can be pivoted around a rotational axis being perpendicular to the plane formed between the bearing elements 12, the driver 11' can be pivoted around an axis being perpendicular to the movement direction of the running rail 4' and the plane formed by the bearing elements 12. The driver 11' comprises a recess 30 being located between two protrusions 31 and 32. The web-shaped activator 46 can engage in the recess 30 in order to move the driver 11' against the forces of the spring 9 and the damper 8.

The driver 11' is guided along a modified guide track 63', which, instead of an angled end portion, has a recess 64', on which the driver 11' with a tensioned spring 9 can be latched. In this parking position, the driver 11' is pivoted, in order to turn the recess 30 and release the web-shaped activator 46, so that the running rail 4' can be moved uncoupled from the retraction device 5'. When the running rail 4' is moved again in the closing direction, the web-shaped activator 46 impinges on the protrusion 32 of the driver 11', so that it becomes unlatched from its latched parking position and is then moved by the tension of the spring 9 and slowed down by the damper 8 in the closing direction. However, the manner of functioning of the retraction device 5' corresponds to the one of the retraction device 5 already discussed in detail.

Figure 14A:
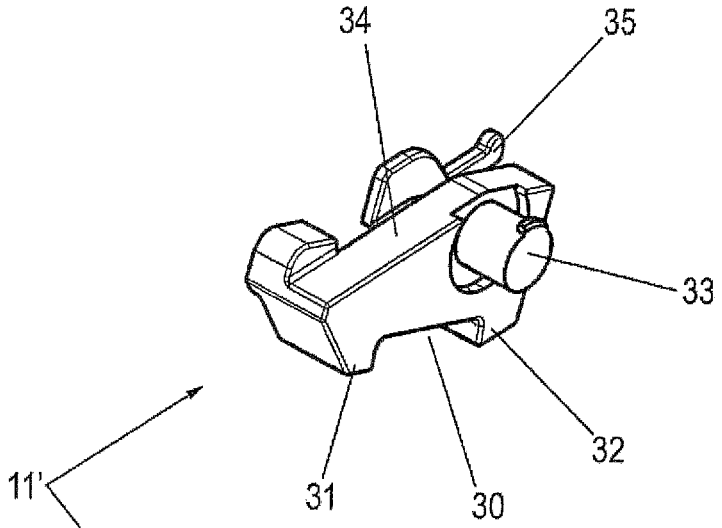
FIGS. 14A and 14B show two views of the driver of the retraction device as shown in FIG. 13.
Figure 14B:
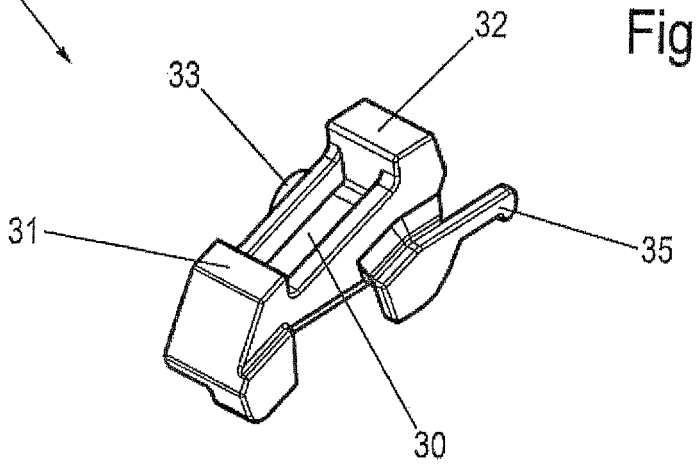

FIGS. 14A and 14B show the driver 11' in detail. The driver 11' comprises a pin 33, which can be inserted in the opening 76' of the slider 7'. Further, a recess 30 is formed on the driver 11', which is surrounded by two protrusions 31 and 32, so that it can receive the web-shaped activator 46 in the recess. In the axial extension of the pin 33, an arm 35 is further provided, which serves the purpose of guiding and moving the driver 11'. On the side facing the recess 30 an even sliding surface 34 is arranged, which can be moved on the guide 63' of the housing 6.

Figure 15:
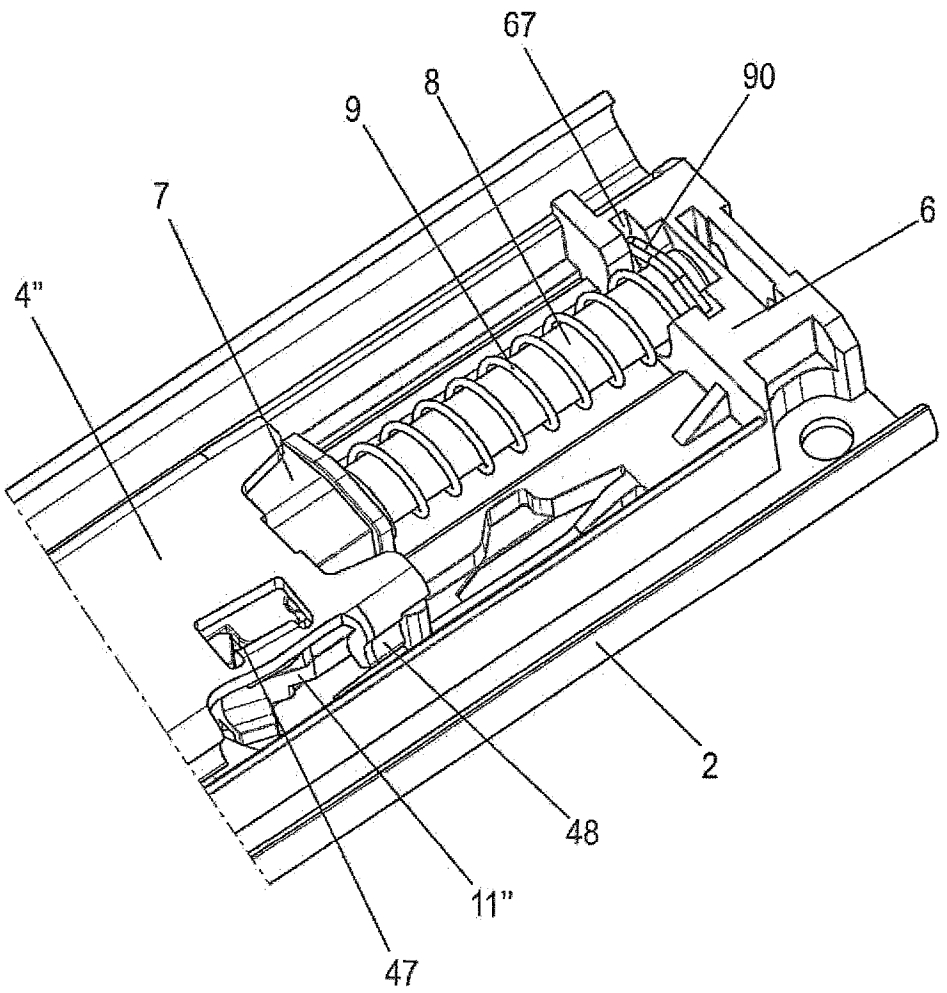
FIG. 15 is a perspective view of a pull-out guide with a modified activator.

FIG. 15 shows a modified pull-out guide with a retraction device, which is similar to the previous embodiments with the exception of a bent arm as activator 47 being formed on the running rail 4". The bent arm of the activator 47 is arranged in an end section of the running rail 4", wherein the activator 47 can engage with a modified driver 11". Apart from that, the retraction device comprising the damper 8, the spring 9, the slider 7 and the housing 6 is assembled similar to the previous embodiments. Further, on the running rail 4" a web 48 is formed which interacts with a protrusion of the driver 11" in order to unlatch the driver 11" from its parking position on an angled end portion 64 of the guide rail 63.

Figure 16:
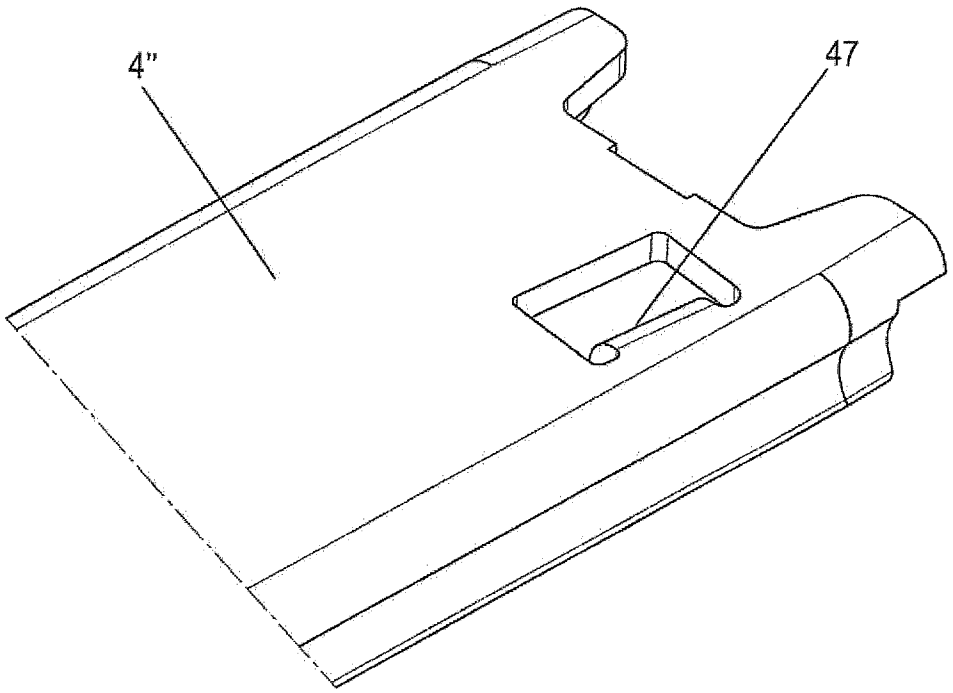
FIG. 16 is a perspective detailed view of the running rail of the pull-out guide as shown in FIG. 15.

FIG. 16 shows the running rail 4" in detail, wherein an opening is punched out in its end section, on which the arm as the activator 47 is basically bent in a right angle.

Figure 17A:
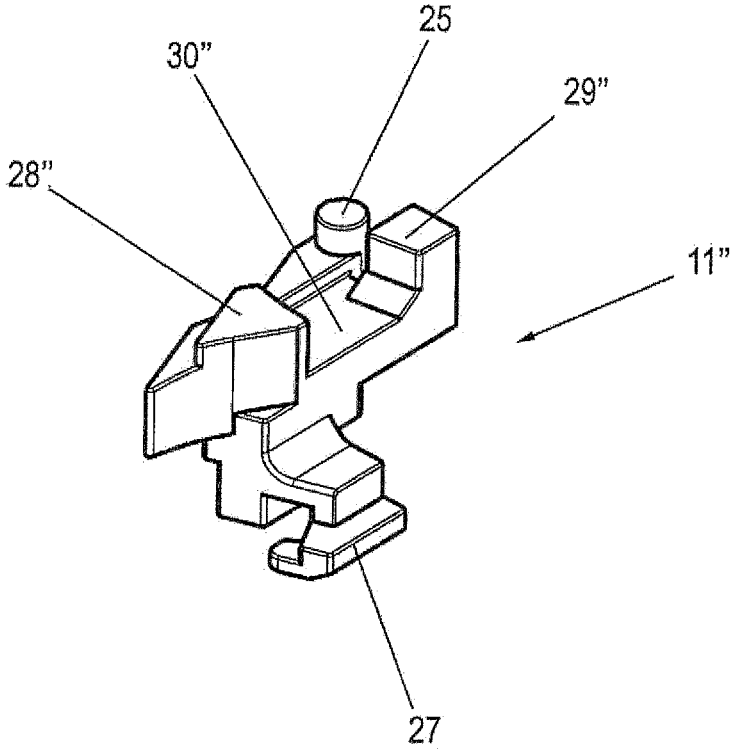
FIGS. 17A and 17B show two views of the driver of the retraction device as shown in FIG. 15, and FIGS. 18A and 18B show two views of a modified driver.
Figure 17B:
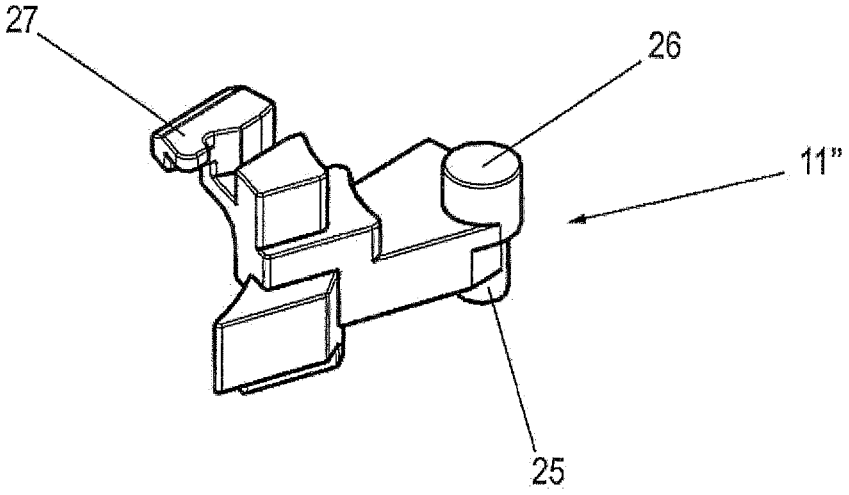

FIGS. 17A and 17B show the driver 11" in detail, which interacts with the activator 47. The driver 11" comprises a recess 30", into which the activator 47 protruding from the running rail 4" can be inserted, so that the activator 47 is held between two protrusions 28" and 29". The driver 11" further comprises a guide portion 27, which engages in the guide rail 63 on the housing 6. On the driver 11", a bearing pin 26 is formed, which can be inserted into the bearing 76 on the slider 7, and in the axial extension of the bearing pin 26 a bolt 25 is arranged, which can be inserted into the latching recess 77 on the slider 7. Also in case of this driver 11", the activator 47 can be formed integrally with the running rail 4".

Figure 18A:
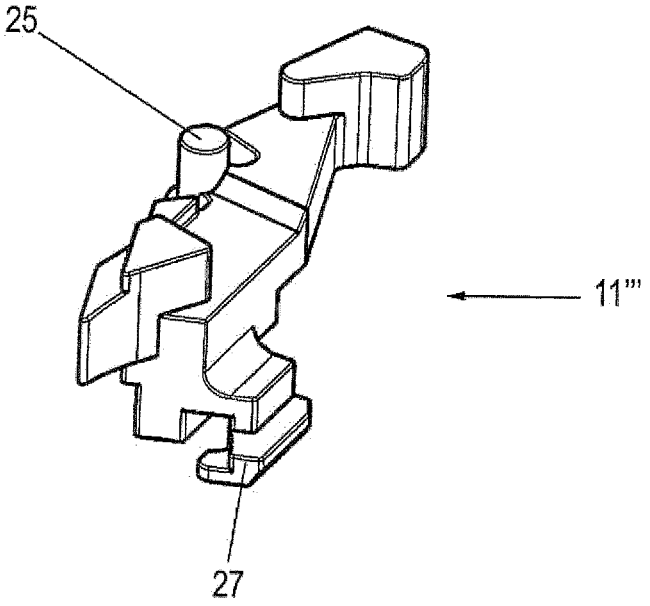
Figure 18B:
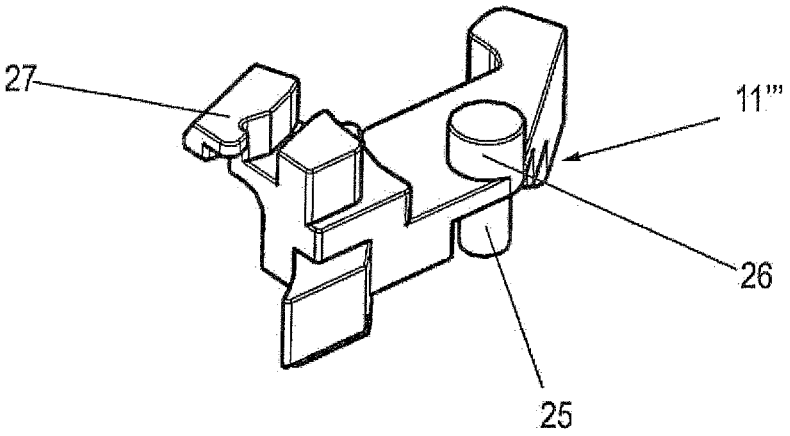

FIGS. 18A and 18B show a further embodiment of a driver 11''' comprising a bearing pin 26, a bolt 25 and a guide portion 27. Through the other geometric embodiment of the driver 11''', it is possible to modify the activator.

LIST OF REFERENCE SIGNS

1 pull-out guide
2 guide rail
3 middle rail
4, 4', 4" running rail
5, 5' retraction device
6 housing
7, 7' slider
8 damper
9 spring
10 activator
11, 11', 11", 11' driver
12 bearing element
13 bearing element cage
14 bearing element cage
15 protrusion
16 opening
17 protrusion
18 protrusion
19 fixing means
20 bottom
21 leg
22 web
23 arm
24 holder
25 bolt
26 bearing pin
27 guide portion
28, 28" protrusion
29, 29" protrusion
30, 30' recess
31 protrusion
32 protrusion
33 pin
34 sliding surface
35 arm
40 bottom
41 web
42 web
43 oblong hole
44 opening
45 recess
46 activator
47 activator
48 web
60 recess
61 guide
62 web
63, 63' guide track
64, 64' end portion
65 wall portion
66 opening
67 pocket
68 wall
70 recess
71 web
72 holder
73 sliding element
74 pocket
75 guide strip
76, 76' bearing
77 latching recess
80 damper housing
81 piston rod
82 head portion
90 end
91 end

What is claimed is:

1. Pull-out guide (1) comprising a stationary guide rail (2) and a running rail (4, 4', 4") that can be moved relative to the guide rail (2), wherein a retraction device (5) is provided and arranged between the running rail (4, 4', 4") and the guide rail (2) in the retracted position of the pull-out guide (1), and wherein the guide rail (2) and the running rail (4, 4', 4") are C- or U-shaped in cross section and legs of the guide rail (2) and the running rail (4, 4', 4") are facing each other, said retraction device having a housing (6), in which a guide (61) for a linearly movable slider (7, 7') and a guide track (63) for a driver (11, 11', 11", 11''') attached to the slider (7, 7') are provided, wherein the driver (11, 11', 11", 11''') is configured to be coupled with an activator (10) and between the housing (6) and the slider (7, 7') a damper (8) comprising a damper housing (80) and a piston rod (81) is provided, wherein a compression spring (9) is arranged surrounding the damper by means of which the slider (7, 7') is pretensioned on the housing (6) in a retracted position.

2. Pull-out guide according to claim 1, wherein the spring (9) is designed as a spiral spring, which is arranged around the damper housing (80).

3. Pull-out guide according to claim 1, wherein the spring (9) is fixed on a first end (90) on a first mounting (67) attached to the housing (6) and on a second end (91) on a second mounting (74) attached to the slider (7, 7').

4. Pull-out guide according to claim 3, wherein the spring (9) has at least one coil each at least partly protruding in the radial direction on its first end (90) or on its second end (91).

5. Pull-out guide according to claim 1, wherein the damper housing (80) is held in a recess (60) of the housing (6) and the slider (7, 7') can be moved together with the piston rod (81), or that the piston rod (81) is held on the housing (6) and the slider (7, 7') can be moved together with the damper housing (80).

6. Pull-out guide according to claim 1, wherein the driver (11, 11', 11", 11'") is mounted pivotably on the slider (7, 7').

7. Pull-out guide according to claim 1, further comprising the activator (10), wherein the activator is configured to be coupled with the driver (11, 11', 11", 11'"), and is arranged on the running rail (4) or on a thrust element coupled with the running rail.

8. Pull-out guide according to claim 1, wherein between the guide rail (2) and the running rail (4, 4', 4") a middle rail (3) is provided, which is shorter than the guide rail (2) and the running rail (4, 4', 4"), and the retraction device (5) is arranged in extension of the middle rail (3).

9. Pull-out guide according to claim 1, further comprising the activator (46) wherein the activator is configured to be coupled with the driver (11') and is formed integrally with the running rail (4').

10. A pull-out guide comprising:

a stationary guide rail (2), a running rail (4, 4', 4") that is configured to be moved relative to the guide rail (2) wherein the guide rail (2) and the running rail (4, 4', 4") are C- or U-shaped in cross section and legs of the guide rail (2) and the running rail (4, 4', 4") are facing each other, a retraction device (5) arranged between the running rail (4, 4', 4") and the guide rail (2) in the retracted position of the pull-out guide (1), the retraction device comprising a housing (6), a guide (61) for a linearly movable slider (7, 7') and a guide track (63) for a driver (11, 11', 11", 11'") attached to the slider (7, 7'), the guide and guide track being provided in the housing, wherein the driver (11, 11', 11", 11'") is configured to be coupled with an activator (10), wherein a damper (8) comprising a damper housing (80) and a piston rod (81) is provided between the housing (6) and the slider (7, 7'), wherein a spring (9) is arranged surrounding the damper by means of which the slider (7, 7') is pretensioned on the housing (6) in a retracted position, and wherein the driver is arranged on a side of the damper and is pivotable around a bearing.

* * * * *